US005253495A

United States Patent [19]

Zimmer

[11] Patent Number: 5,253,495

[45] Date of Patent: Oct. 19, 1993

[54] APPARATUS FOR THE MULTIPLE PROCESING OF A WEB

[76] Inventor: Johannes Zimmer, Ebentaler Strasse 133, A-9020 Klagenfurt, Austria

[21] Appl. No.: 949,697

[22] Filed: Sep. 23, 1992

[30] Foreign Application Priority Data

Sep. 23, 1991 [AT] Austria ..... 1912/91

[51] Int. Cl.[5] ..... D06B 1/14

[52] U.S. Cl. ..... 68/43; 68/202; 118/249

[58] Field of Search ..... 68/205 R, 202, 43; 8/151; 101/116; 100/73; 118/206, 249

[56] References Cited

U.S. PATENT DOCUMENTS

| | | | |
|---|---|---|---|
| 323,095 | 7/1885 | Worrall | 68/43 |
| 2,279,553 | 4/1942 | Bradt | 68/202 |
| 2,398,435 | 4/1946 | Marks | 118/249 |
| 2,398,844 | 4/1946 | Muggleton et al. | 118/249 X |
| 3,495,285 | 2/1970 | Zimmer | 68/202 X |
| 4,657,783 | 4/1987 | Tatt et al. | 118/206 |
| 4,845,964 | 7/1989 | Bors et al. | 68/202 X |

FOREIGN PATENT DOCUMENTS

| | | | |
|---|---|---|---|
| PCT/AT87/-00032 | 11/1987 | PCT Int'l Appl. . | |
| 2084049 | 4/1982 | United Kingdom | 68/202 |

*Primary Examiner*—Frankie L. Stinson

*Attorney, Agent, or Firm*—Herbert Dubno; Yuri Kateshov

[57] ABSTRACT

An apparatus for selectively individually or combinatively effecting a number of operations on a web of material has a multiplicity of units disposed around a counterroller or drum providing a surface against which the web can be pressed, one of these units being a squeegee roller unit pressing the web to a selected residual moisture content, another unit being a metering applicator unit and the apparatus having a trough through which the web is guided and at least one roller at least partially immersed in the trough.

17 Claims, 3 Drawing Sheets

APPARATUS FOR THE MULTIPLE PROCESING OF A WEB

CROSS REFERENCE TO RELATED APPLICATIONS

This application is related to my copending applications Ser. Nos. 07/847,029 filed Apr. 13, 1992; 07/765,658 filed Sep. 25, 1991; 07/761,882 filed Sep. 16, 1991; 07/727,622 filed Jul. 10, 1991; 07/659,285 filed Apr. 11, 1991; 07/635,123 filed Mar. 5, 1991; 07/635,115 filed Feb. 13, 1991; 07/919,077 filed Jul. 23, 1992. Reference may also be had to U.S. Pat. Nos. 5,148,743; 5,151,132 and 4,892,057.

FIELD OF THE INVENTION

The present invention relates to an apparatus for multiple processing of a web of material, i.e. for the selective treatment of a web with a multiplicity of steps or the combined treatment thereof with individual working units cooperating with a countersurface against which a web is supported.

BACKGROUND OF THE INVENTION

A web composed of fibrous material, e.g. woven, knitted or pressed (nonwoven) fiber or filament webs, can be processed to yield a variety of end products depending upon the nature of the processing, the starting materials used and the various steps with which the web is treated. These steps may include application of various flowable materials for preparation of the web, coating or conditioning of the web, dyeing or printing of the web and finishing of the web. The steps include usually the application of the liquid or flowable substance alone or in combination with other substances with or without intervening pressing to promote deep impregnation and with or without a squeezing step whereby excess liquid may be removed to a residual moisture content.

These steps have required an appropriate apparatus for each step and it is recognized that it is desirable to carry out the steps without significant loss of time or processing materials in various combinations.

OBJECTS OF THE INVENTION

It is the principal object of the invention to provide an apparatus for the purposes described that can carry out selectively a number of individual processing steps or can carry out these steps in various combinations, selectively so that, for example, a variety of different starting products can be subjected to optionally combinable treatments to yield a variety of end products in a unit which occupies a minimum of space, utilizes individual working devices which can be effective successively and do not interfere with one another, and can be operated with a minimum of downtime for switchover and a minimum of material lost.

Another object of the invention is to provide a highly efficient and versatile apparatus for the processing of a web on a multiplicity of steps whereby drawbacks of earlier systems are avoided.

SUMMARY OF THE INVENTION

These objects are obtained, in accordance with the invention by providing a plurality of working devices around the periphery of a drum or counterroller providing a supporting surface against which a web can be pressed, at least one of the working devices being formed as a squeezing device capable of pressing the web against this surface to a desired residual moisture content and which optionally also can be used as an applicating device. This device, according to the invention has a working roller and one or more slide bearing or journaling beds and/or pressing beams or pressing rollers or cylindrical pressing bodies bearing against this working roller and biased by a hydraulic, pneumatic or mutual fixedly disposed pressing-force generating unit for urging the working roll toward the countersurface and which acts upon the slide bearing or journaling bed and/or pressing body.

According to a feature of the invention, a further working device of the apparatus has a metering applicating unit with an applicating roll rotatable in a trough containing the substance to be applied and magnetically displaceable or pressable against the web while it is supported by the surface of the drum. The flowable substance is introduced into this trough from below via a suitable feed pipe.

According to another feature of the invention, the web is guided through a trough containing the substance to be applied to the web over and under rollers in a meander pattern. This trough can be followed by a guide roller about which the web is deflected and which can be magnetically pressed against the countersurface to serve as a roller applying the web to the surface and as a deep impregnating roller or as a presqueezing roller.

Furthermore, one of the working devices can be a minimum-quantity trough, i.e. dimensioned to contain only the minimum quantity of flowable substance necessary to obtain impregnation or coating of the web and in which a roller is partially immersed so that there is a limited distance between the inner wall of this trough and the outer wall of the roller immersed therein.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
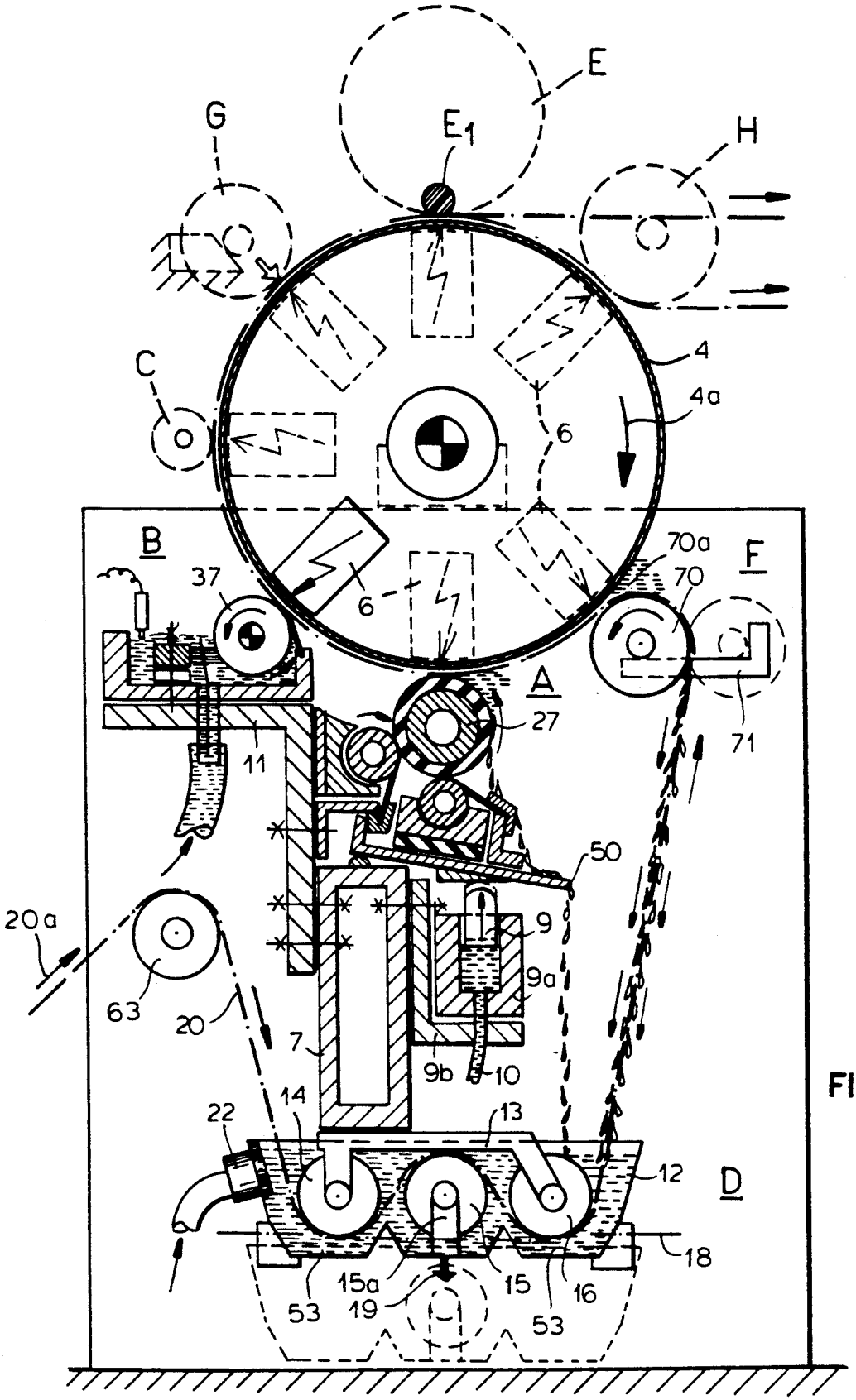
FIG. 1 is a cross sectional view through an apparatus according to the invention for the application of coating materials to a web in which, according to the invention, a squeegee roller device can be used selectively for applying a coating material and removing liquid to a residual liquid or moisture content.

As can be seen from FIG. 1, a plurality of roller-type devices A, B, C, G, E, H and F are arranged in succession about a counterroller or drum 4 around which a web 20 to be treated selectively or alternatively with such devices can pass as the counterroller 4 is rotated in the clockwise sense represented by the arrow 4*a* in FIG. 1. The coating of the web 20 can be effected in an immersion bath unit D, the rollers of which are not juxtaposed with the counterroller 4 so that, in the embodiment of FIG. 1, all of the working units are juxtaposed with the soft surface of the counterroller 4 with the exception of the immersion bath unit D.

The working units, for example, can have squeegee-type rollers, also referred to herein as working rollers 27, 37, 70, for example, which actually can engage the web and can be pressed, when these rollers are used, against the web as supported by the counterrollers.

This pressing can be effected magnetically, hydraulically, pneumatically, mechanically and/or with the aid of gravity. In the embodiment shown, for example, each of the working rollers may be drawn by a respective electromagnets 6 within the drum or counterroller 4 radially against the web and the counterroller and, for this purpose, each working roller 27, 37, 70, . . . may be partly supported by a magnetically attractable material, may consist in whole or in part of a magnetically attractable material, may be provided in a bed which can be magnetically attracted toward the counterroller 4, or may be otherwise so coupled with a magnetically attractable member as to be drawn against the web and the counterroller 4.

If a certain one of these roller devices is not to be active, because, for example, the process carried out thereby, e.g. full or selective surface coating with one or another flowable material such as a liquid, foam or suspension is not to be effected, the respective roller is not pressed against the counterroller. For example, in the case of the working roller 70 of FIG. 1 which rides in the bed 71, the respective electromagnet 6 can be deenergized to allow that roller 70 to move into the broken line position when a squeegee effect of the roller 70 is not desirable or necessary.

As is also apparent from FIG. 1, the web 20 can pass in the direction of arrow 20*a* over a guide roller 63 which serves as a direction change roller, into a trough 12 of the device D and successively under, over and under three rollers 14, 15 and 16 immersed in the flowable substance within this trough 12 the flowable substance can be delivered automatically through to the trough through a delivery unit 22 which also represents a spreader by means of which the coating or impregnating substance or substance mixture can be spread into the trough 12 or onto the web 20.

According to the invention, the spreading device 22 can have a U-shape and can open along three of the four side walls of the trough to effect uniform delivery of the flowable substance thereto. An advantage of this configuration is that for the processing of a web which is significantly smaller in width than the trough itself, the substance will not stagnate along the sides of the web but will remain in constant flow so that substance laterally of the web will continuously flow inwardly into the region of the latter. As a consequence, in no region of the trough will the coating substance stagnate and age to lead to a nonuniform coating.

The web 20 passes in a meander pattern about the rollers 14, 15, 16 through the trough so that the web has a long path within the coating substance and a relatively long residence time in the latter and a relatively long length of the web in contact with the substance, leading to a highly effectively impregnation of the substance into the web.

To promote the uniformity of the coating, the bottom of the trough may be formed with depressions 53 whose widths correspond generally to the diameters of the rollers 14, 15, 16 and which reduce the volume of the coating substance below these rollers so that significantly less impregnating liquid is required in the trough than would be the case in the absence of these depressions proportioned to the diameters of these rollers. These lead to a considerable cost saving since the losses of the coating substance because of residues thereof in the trough are reduced. In addition, by comparison with earlier devices, the trough system occupies less space than other immersion coating systems.

The trough 12 can be lowered, together with the intermediate roller 15 whose journal support 15*a* is affixed to the trough, by appropriate means represented at 19. This means can include a hydraulic or pneumatic cylinder or a mechanical lever system. The rollers 14 and 16 can be mounted on a frame 13 affixed to a stable girder 7 of the machine housing so that the rollers 14 and 16 remain in their illustrated position when the trough 12 is lowered. This permits the web to be easily inserted and the trough to be easily emptied by tilting it about its axis 18, whereby the trough can be cleaned.

If the web is then to be coated with another substance, the trough can be filled and raised again. However, if it is desired to process the web without immersion in the trough, the rough can remain in its lowered position, whereby the rollers 14 and 16 serve only as guide rollers beneath which the web can pass to the counterroller or drum 4.

In the configuration of the apparatus as illustrated in FIG. 1, the impregnated web 20 passes upwardly from the trough to the working unit F whose roller 70 is drawn magnetically toward the counterroller 4 so that the roller 70, around which the web 20 passes to come to lie against the surface of the counterroller presses the web with a force determined by the magnetically applied force.

The roller 70 serves to press the impregnating substance into the web, although a bank 70*a* of the substance can form between the web and the counterroller 4 and any excess of the impregnating substance can flow downwardly along the web.

Depending upon the strength of the magnetic force generated by the electromagnets 6 juxtaposed with the roller 70, the roller 70 can assume various positions along the guide bar formed by its support 71 to press the substance into the web with greater or lesser force. When its electromagnets 6 are shut down, however, the roller 70 can assume its broken line position as illustrated in FIG. 1.

Figure 2:
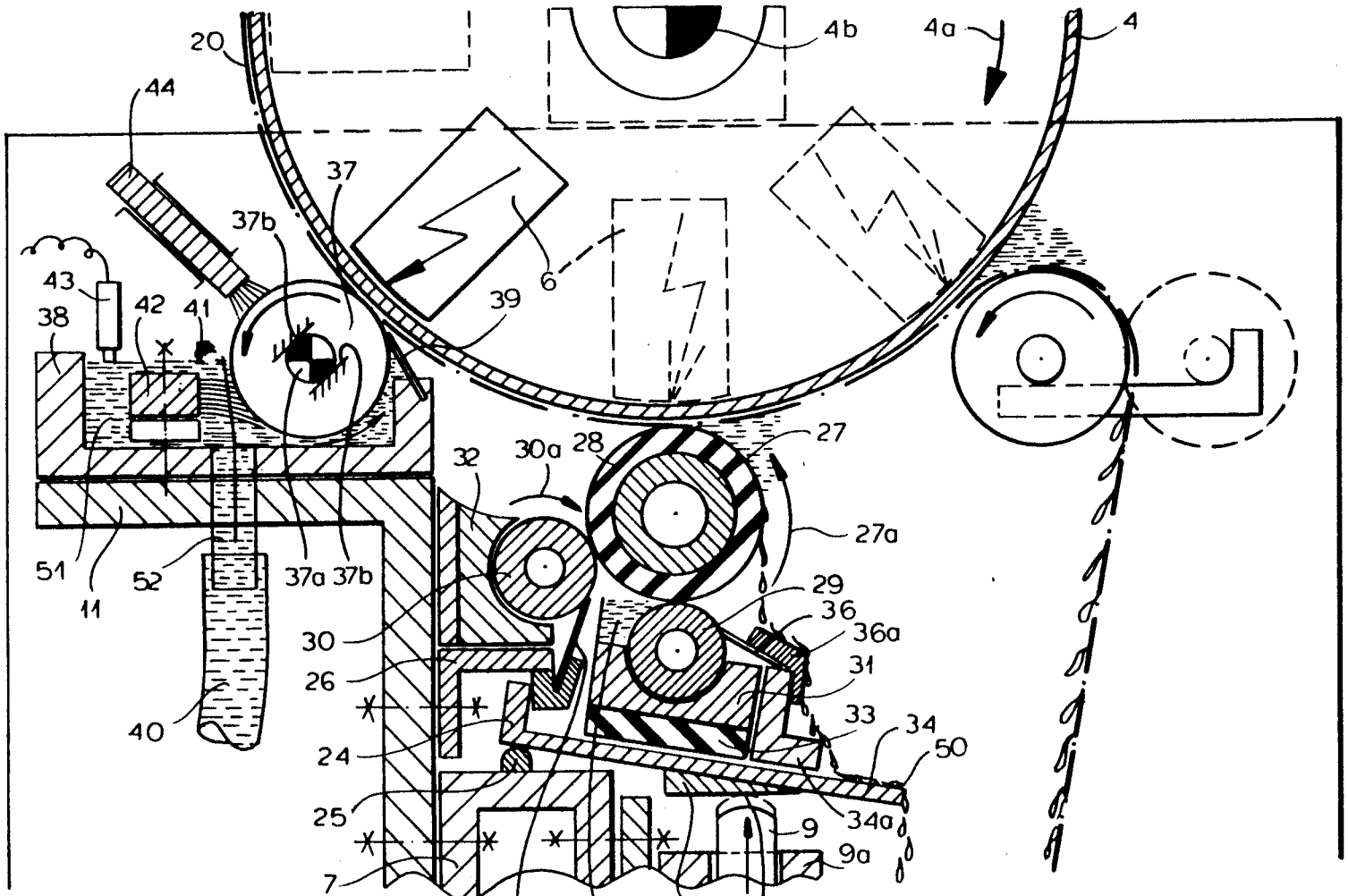
FIG. 2 is a detail of this device also in cross section and of a device for applying a liquid to the web.

Following the roller 70 in the path of the web and around the drum 4 in the sense of rotation thereof is the squeegee roller device A shown to a larger scale in FIG. 2.

This device comprises a working roller 27 which can be composed of a magnetically attractable material and which is covered by a bibulous, liquid-take-up and liquid transporting yieldable sheath or jacket 28 and is supported without axial bearings in a bed or cradle formed by two supporting, pressing and bearing rollers or cylindrical bodies 29 and 30 which preferably are rotatable in senses opposite the sense of rotation of the roller 27. When the drum 4 is rotated in a clockwise sense as represented by the arrow 4*a* about its axis on a shaft 4*b* by a drive means not shown, the roller 27 will be rotated in the counterclockwise sense represented by arrow 27*a* and the support or bearing rollers 29 and 30 forming the cradle for the roller 27, will rotate in the clockwise sense represented by the arrow 30*a* as seen in FIG. 2.

The support roll 30 can be journaled in a side bearing bed 32 or the like which is fixed on a bracket 26 rigidly connected with the girder 7 previously mentioned and on which the housing bracket 11 is also mounted.

The support and press roller 29 is also rotatable in a bearing bed or slide bearing arrangement 31 which, however, rests upon a rubber cushion 33 providing an elastic mounting for the bed 31. The bed 31 and the elastic mounting 33 are held against lateral movement by a brace 34*a* connected to a plate 34 referred to herein as a pressing plate and which is movable about a fulcrum formed by support ridge 25 on the girder 4. In the extreme lowered position of the plate 34, a projection 24 thereof engages an abutment 26*a* carried by the bracket 26. The plate 34 is therefore swingable as a lever relative to the support structure represented by the bracket 11, the bracket 26 and the girder 27.

At its underside, the pressing plate 34 is provided with an intervening plate 61 having a substantially horizontal lower surface against which a piston 9 of a hydraulic cylinder 9*a* can bear at an abutment point 62. The piston 9 is shown to be retracted from the bearing plate 61 in FIGS. 1 and 2, although it will be understood that the hydraulic cylinder can be pressurized via a line 10 to drive the piston 9 upwardly and swing the plate 50 in the counterclockwise sense to press the roller 29 against roller 27 and squeeze the web between the jacket 28 of the roller 27 and the drum 4.

The hydraulic cylinder 9*a* is mounted on an angle bracket 9*b* also fixed to the girder 7. Thus the hydraulic cylinder arrangement 7, 9*a* provides the pressure which is applied between the working roller 27 and the counterroller 4. The support roller 30 serves then as a counterpressure roller.

Preferably the working roller 27 squeezes the excess quantities of the flowable substance from the web 20. This excess substance flows along the upstream surface of the jacket 28, over a bracket 36*a* supporting a wiper or scraper 36 which strips liquid from the pressing roller 29 and onto a drip edge 50 overhanging the trough 12 from which the liquid returns to that trough.

Depending upon the type of operation carried out by the roller 27, the surfaces of the rollers 29 and 30 can be textured or smooth, hard or soft, bibulous or nonabsorbing and movable or nonmovable and the bearing surfaces of the beds 31 and 32 can be likewise configured or constructed. Generally these factors will depend upon the speed with the working roller 27 and the pressing force which is applied thereto.

In the rest state, the bodies 29 and 30 simultaneously assist in cleaning the working roller 27.

The squeegee device A can optionally also serve as an applicator for a flowable substance. An example of this is shown in FIG. 2 where the bed 31 serves simultaneously as a trough for application of a flowable substance so by the roller 29 to the bibulous jacket 28 which carries this substance onto the web 20 on the drum 4. In this case, the substance 60 can be a material different from the material within the trough 12.

Following the device A, the web can encounter an applicating device B which can apply a dosed or metered quantity of a further liquid or flowable substance 51 to the web.

In this device, a multiplicity of magnets 6 are radially juxtaposed with a liquid applying roller 37 which is magnetically attracted toward the magnet 6 and hence against the web 20 and the counterroller or drum 4.

The applicator roller 37 has its shaft 37*a* guided in, for example, a guide 37*b* for radial movement with respect to the drum 4 within trough 38 carrying the substance 51 which is to be applied to the web. A stripper 39, in the form of a blade, can press against the roller 37 to remove excess substance 51 therefrom. The substance 51 is distributed to the trough 38 by a distributing device 52 feeding the trough from below and all along the roller 37.

A brush bar 41 has its bristles engaging the roller 37 and fastened with its base 42 on the bottom of the trough 38. The bristles of the brush bar 41 serve to clean the applicator roller 37 on the one hand and to remove air which may be trapped on the surface thereof on the other. For additional cleaning, a second brush bar 44 outside the trough 38 can be provided directly downstream of the contact of the applicator roller 37 with the controller or drum 4. The filling height of the trough 38, connected by the bracket 11 with the stable girder 7 is monitored or controlled by a sensor 43.

Further downstream of the applicator roller device B in the sense of rotation of the drum 4 (FIG. 1) is a pressing roller G guided radially and drawn by an array of electromagnets 6 against the web and the drum to press the coating substance into the web. This roller device G can be referred to as an after pressing deep-impregnation roller. In other words, the substance applied to the web in the trough 12, pressed somewhat into the web at the presqueezing roller 70, is partly squeezed out of the web at the squeegee roller device A and the residue and any of substance 51 applied by the device B is deep-pressed into the web by the roller device G.

The device E can be a cylindrical printing screen provided with a doctor bar $E_1$ for the screen printing of the impregnated web with an appropriate pattern, or an equivalent screen coating device for the full width coating of the web. The doctor bar $E_1$ is also drawn magnetically toward the drum 4 by electromagnets 6.

Still another roller H drawn magnetically against the drum can provide for deflection of the web as has been illustrated in FIG. 1 for additional deep impregnation or to increase the duration of contact of the web with the drum 4. If the device H is omitted or the magnetic force relieved on the roller H, the web can pass tangentially from the drum 4 at the device E, $E_1$.

Figure 3:
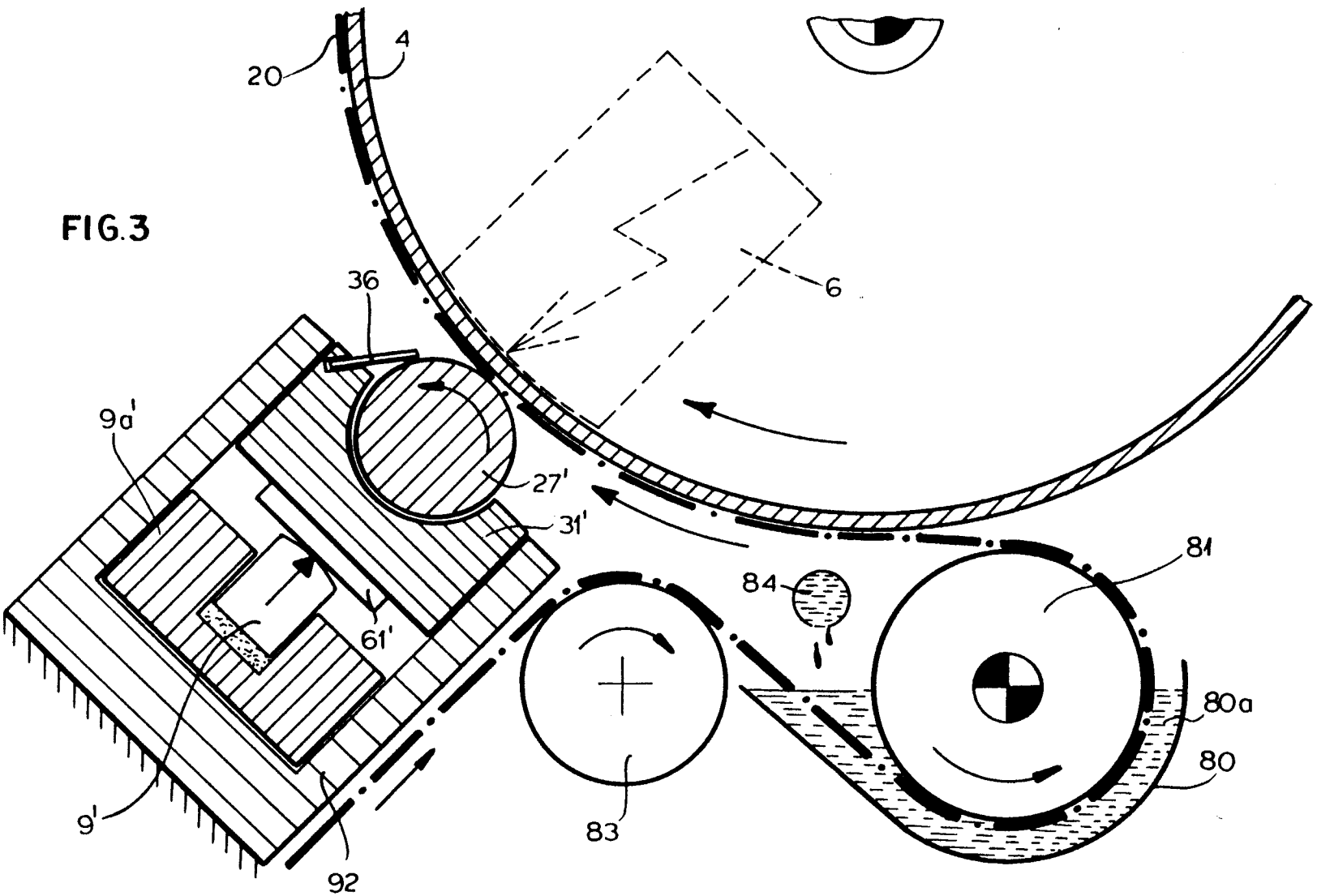
FIG. 3 is a cross section through another squeegee roller device according to the invention.

In FIG. 3 I have shown two further units which may be additionally or alternatively provided along the drum 4 for engagement with the web 20.

The web 20 may pass via a guide and deflection roller 83 into a trough 80 containing a flowable substance 80*a* in a minimum quantity necessary for impregnation of the web along the periphery of an impregnation roller 81 partially immersed in this substance.

To minimize the quantity of the liquid in this trough, the trough 80 closely surrounds the roller 81. Thus there is a minimum volume between the inner roller of the trough 80 and the outer surface of the roller 81. Since practically all of the flowable substance is rapidly picked up by the web, additional amounts of the flowable substance may be continuously added thereto by a liquid feed pipe 84 extending the full machine width and the full length of the trough and distributing the liquid thereto. Here also there are minimum losses of liquid. From the trough 80, the web passes onto the surface of the counterroller 4 where it is engaged by a squeezing roller 27' which has the function of the squeezing roller 27 described in connection with FIGS. 1 and 2. In this embodiment, the squeezing roller 27' is rotatable in a slide bearing bed 31' which can be pressed by a piston 9' of a hydraulic cylinder 9*a'* against the drum 4. For this purpose, the slide bearing bed 31' may have a bearing plate 61' engaged by the piston 9' and can be guided in a stationary guide structure 92. Electromagnets 6 may also be effective to draw magnetically attractable roller 27′ toward the drum 4 as indicated in broken lines. Alternatively or, in addition, the bed 31′ may be magnetically attractable.

A wiper blade or strip 36 can bear against the roller 27′ at its downstream side to scrape adherent substance from the surface of the roller 27′.

I claim:

1. An apparatus for selective processing of a web with a plurality of individual devices and a combination thereof, said apparatus comprising:

a drum rotatable about an axis and forming a counter surface; and a plurality of processing devices arrayed around said drum for effecting respective processing operations upon a web lying against said surface and including rollers urged against said web while said web is supported by said surface, one of said devices being a squeezing device pressing said web to a dosed residual moisture content and optionally operable as a liquid-substance applier, said one of said devices including:

a squeegee working roller engageable with said web, support means extending over a length of said squeegee working roller and engageable therewith over a length thereof in contact with said web and selected from at least one slide-bearing bed, at least one pressing roller, at least one pressing bar and at least one cylindrical pressing body, and a pressing-force generator selected from a hydraulic, pneumatic or mechanical driver fixedly positioned relative to said drum and bearing upon said support means for urging said squeegee working roller against said web and said surface.

2. The apparatus defined in claim 1 further comprising magnet means acting upon said squeegee working roller for generating a magnetic force pressing said squeegee working roller against said web and said countersurface.

3. The apparatus defined in claim 1 wherein said support means is bendable in a direction toward said working roll or in a direction of application of pressing force from said generator on said working roller.

4. The apparatus defined in claim 1 wherein said support means includes two support bodies, at least one of said support bodies forming a pressing body for pressing said working roller toward said countersurface, the other of said bodies being a cylindrical counterroller supporting said working roller and lying in a bearing bed, said one of said rollers lying in a second bearing bed having an elastic cushion separating same from a movable pressing plate upon which said pressing force generator acts.

5. The apparatus defined in claim 4 wherein said pressing plate is bendable in a direction toward said working roller or in a direction of application of pressing force by said generator thereupon.

6. The apparatus defined in claim 5 wherein said pressing plate is swingable about a fixed fulcrum.

7. The apparatus defined in claim 5 wherein a retaining element is fixed to said plate and held in a fixed girder, said pressing plate and the girder being connected by a pivot.

8. The apparatus defined in claim 5 wherein said bodies are rollers and at least one of the rollers forming a respective one of said bodies is provided with a stripper blade bearing thereagainst.

9. The apparatus defined in claim 1 wherein said one of said devices is disposed beneath, at a side of or inclined to said drum.

10. The apparatus defined in claim 1 wherein another of said processing devices is a metering applicator having an applicator roller pressed by magnetic force against said web and said counterforce and at least partly immersed in a liquid containing space in a flowable substance and provided with a stripper blade for removing excess substance from said applicator roller.

11. The apparatus defined in claim 10 wherein at least one of said applicator rollers has a friction drive.

12. The apparatus defined in claim 1 further comprising a trough filled with a flowable substance to be applied to said web and having a plurality of rollers around which said web passes in a meander pattern.

13. The apparatus defined in claim 12 further comprising a U-shaped distributor for said substance delivering said substance to said trough at least along three side walls thereof.

14. The apparatus defined in claim 12 wherein three rollers are immersed in said trough, a center one of said three rollers being affixed to said trough and the two other rollers being connected to a horizontal girder extending across said apparatus.

15. The apparatus defined in claim 14 further comprising means for raising and lowering said trough.

16. The apparatus defined in claim 15 wherein another of said devices includes a guide roller for said web composed at least partly of magnetic material, magnetically pressed against said web and said countersurface and forming a deep impregnation or deep squeezing roller.

17. The apparatus defined in claim 1 wherein another of said devices includes a minimum volume trough containing a flowable substance to be applied to said web and a roller partly immersed in said trough and along which said web is guided, an inner wall of said trough having a round cross section conforming substantially to that of the roller immersed in said trough.

* * * * *